US006568335B2

(12) United States Patent
Hamilton et al.

(10) Patent No.: US 6,568,335 B2
(45) Date of Patent: May 27, 2003

(54) FURNITURE ACCESSORY SUPPORTING SYSTEM

(75) Inventors: John R. Hamilton, Grand Rapids, MI (US); Daniel Grabowski, Grand Rapids, MI (US); James N. Ludwig, East Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 11 days.

(21) Appl. No.: 09/882,650

(22) Filed: Jun. 15, 2001

(65) Prior Publication Data

US 2002/0189506 A1 Dec. 19, 2002

(51) Int. Cl.[7] ..... A47B 37/00
(52) U.S. Cl. ..... 108/50.02; 312/233.6
(58) Field of Search ..... 108/50.01, 50.02, 108/42, 27, 60, 156; 312/223.3, 223.6, 195, 194, 196; 52/36.2, 36.4; 248/250

(56) References Cited

U.S. PATENT DOCUMENTS

| | | | |
|---|---|---|---|
| 358,626 | A | 3/1887 | Robinson |
| 433,032 | A | 7/1890 | Rawlings |
| 995,410 | A | 6/1911 | McClure |
| 1,094,812 | A | 4/1914 | Reck |
| 1,495,189 | A | 5/1924 | Mack |
| 1,952,749 | A | 3/1934 | Ellis |
| 2,752,218 | A | 6/1956 | Shea, Sr. |
| D183,441 | S | 8/1958 | Williams |
| 2,852,221 | A | 9/1958 | Steiner |
| D186,896 | S | 12/1959 | Monroe et al. |
| 2,942,924 | A | 6/1960 | Stangert |
| 2,981,583 | A | 4/1961 | Eisenberg |
| 3,261,584 | A | 7/1966 | Miller |
| 3,517,822 | A | 6/1970 | Wagner |
| 3,748,006 | A | 7/1973 | Levit et al. |
| 3,986,780 | A | 10/1976 | Nivet |
| 4,035,097 | A | 7/1977 | Bachand |
| 4,161,303 | A | 7/1979 | Bachand |
| 4,377,976 | A | 3/1983 | Porter |
| 4,530,539 | A | 7/1985 | Gaber et al. |
| 4,569,498 | A | 2/1986 | Ermanski |
| 4,586,746 | A | 5/1986 | Day et al. |
| 4,612,863 | A | 9/1986 | Vonhausen et al. |
| 4,619,486 | A | 10/1986 | Hannah et al. |
| 4,731,900 | A | 3/1988 | Frobose |
| 4,818,016 | A | 4/1989 | Mariol et al. |
| 4,883,330 | A | 11/1989 | Armstrong et al. |
| 4,914,873 | A | 4/1990 | Newhouse |
| D309,839 | S | 8/1990 | Newhouse |
| D311,833 | S | 11/1990 | Newhouse |
| D321,447 | S | 11/1991 | Newhouse |

(List continued on next page.)

FOREIGN PATENT DOCUMENTS

| | | | |
|---|---|---|---|
| DE | 1148679 | | 4/1969 |
| JP | 11-101570 | * | 9/1997 |

*Primary Examiner*—Jose V. Chen
(74) *Attorney, Agent, or Firm*—Price, Heneveld, Cooper, DeWitt & Litton

(57) ABSTRACT

An office desking system includes a worksurface and an accessory system configured for flexible and adjustable attachment to an edge of the worksurface. The accessory system includes C-shaped clamps with legs and an intermediate section forming a cavity for engaging the edge. Each of the legs and the intermediate section have an attachment feature, such as threaded holes, with the top leg potentially including two attachment features. Accessories such as upright slatwall panels, upright erasable panels, upright tackable panels, upright screens, shelves, downwardly-extending modesty panels, "full height" up-and-down screens, and wire managers are attachable to one or more of the attachment features, in various combinations, to provide a useful and flexible accessory system.

27 Claims, 9 Drawing Sheets

U.S. PATENT DOCUMENTS

| | | | | |
|---|---|---|---|---|
| 5,092,253 | A | | 3/1992 | Grund et al. |
| 5,142,832 | A | | 9/1992 | Branham, Sr. et al. |
| 5,473,994 | A | * | 12/1995 | Foley et al. |
| 5,486,042 | A | | 1/1996 | Heisler et al. |
| 5,522,324 | A | * | 6/1996 | Van Gelder et al. |
| D374,125 | S | | 10/1996 | Bernstein et al. |
| 5,609,112 | A | | 3/1997 | Meyer et al. |
| 5,655,670 | A | | 8/1997 | Stuart |
| 5,673,632 | A | * | 10/1997 | Sykes |
| 5,775,521 | A | | 7/1998 | Tisbo |
| 5,901,513 | A | * | 5/1999 | Mollenkopf et al. |
| 5,906,420 | A | | 5/1999 | Rozier, Jr. et al. |
| 5,908,002 | A | | 6/1999 | Alexander et al. |
| 5,947,034 | A | | 9/1999 | Belka et al. |
| 5,971,171 | A | | 10/1999 | Thorp et al. |
| 5,974,985 | A | * | 11/1999 | Flototto et al. |
| D422,429 | S | | 4/2000 | Belka et al. |
| 6,044,982 | A | | 4/2000 | Stuart |
| D423,828 | S | | 5/2000 | Wilkinson |
| 6,058,851 | A | * | 5/2000 | Alexander et al. |
| 6,076,474 | A | | 6/2000 | Grabowski et al. |
| 6,101,954 | A | * | 8/2000 | Rein et al. |
| 6,119,992 | A | | 9/2000 | Stuart |
| 6,146,046 | A | * | 11/2000 | Oberle |
| 6,170,410 | B1 | | 1/2001 | Gioacchini et al. |
| 6,182,579 | B1 | * | 2/2001 | Chang |
| 6,196,140 | B1 | * | 3/2001 | Newhouse et al. |
| 6,202,567 | B1 | * | 3/2001 | Funk et al. |
| 6,213,191 | B1 | | 4/2001 | Nitzsche |
| 6,244,193 | B1 | * | 6/2001 | Gutgsell et al. |
| 6,267,064 | B1 | * | 7/2001 | Ostertag et al. |

* cited by examiner

FURNITURE ACCESSORY SUPPORTING SYSTEM

BACKGROUND OF PRESENT INVENTION

The present invention relates to furniture for use in an interior office environment, and more particularly relates to a desking system where it is desirable to attach accessories and screens to edges of a worksurface.

It is often desirable to provide worksurface-supported accessories to help organize an office for efficiency and to allow personalization of the office. However, accessories take up space on a worksurface, and further can result in a cluttered and unattractive appearance. Some accessory systems support accessories above a worksurface, but in order to do so they require multiple clamps and worksurface attachment devices. These various attachment devices compete for edge space on the worksurface, and further are often not as flexible nor as adaptable as desired. Also, improved and more flexible screening and visual separation of space is desired, while maintaining functionality around the worksurface.

Accordingly, a worksurface engaging system is desired having increased capabilities, functionality, and utility.

SUMMARY OF THE PRESENT INVENTION

In one aspect of the present invention, a desking system for use in an interior office environment having a floor includes a worksurface panel having an upper substantially planar surface and a lower substantially planar surface and an edge disposed between the upper and lower surfaces. A support structure is attached to the worksurface panel and positions the worksurface panel above the floor. At least one clamping device is secured to the worksurface panel proximate the edge of the worksurface panel, the clamping device having an upper clamp element positioned proximate the upper surface, and a lower clamp element positioned proximate the lower surface. The clamping device has at least three attachment features. A first support extends from a first one of the attachment features, the first support secured to a first substantially vertically oriented planar member positioned above the upper surface. A second support extends from a second one of the attachment features, the second support being secured to a second substantially vertically oriented planar member positioned below the lower surface. An accessory is secured to a third one of the attachment features.

In another aspect of the present invention, a desking system for use in an interior office environment having a floor includes a worksurface panel having an upper substantially planar surface and a lower substantially planar surface and an edge disposed between the upper and lower surfaces. A support structure is attached to the worksurface panel and positions the worksurface panel above the floor. At least one clamping device is secured to the worksurface panel proximate the edge of the worksurface panel, the clamping device having a plurality of attachment features. A first substantially vertically oriented substantially planar screen is secured to the clamping device in first and second positions, each of the first and second positions being located outwardly proximate the edge of the worksurface panel so that when the first screen is located in the first position, a majority of the first screen is located below the worksurface panel, and when the first screen is located in the second position, a majority of the first screen is located above the worksurface panel. A second substantially vertically oriented substantially planar screen is secured to the clamping device in third and fourth positions, the third position placing the second screen above the worksurface panel inwardly of the edge of the worksurface panel and the fourth position placing the second screen below the worksurface panel inwardly of the edge of the worksurface panel.

In another aspect of the present invention, a desking system for use in an interior office environment having a floor includes a worksurface panel having an upper substantially planar surface and a lower substantially planar surface and an edge disposed between the upper and lower surfaces. A support structure is attached to the worksurface panel and positions the worksurface panel above the floor. At least one clamping device is secured to the worksurface panel proximate the edge of the worksurface panel, the clamping device having a plurality of attachment features. A shelf has a support secured to the clamping device at one of the attachment features. The shelf is disposed at height above and at an orientation substantially parallel to the worksurface panel. A substantially vertically oriented substantially planar screen is secured to the clamping device at one of the attachment features.

In another aspect of the present invention, a desking system for use in an interior office environment having a floor includes a worksurface panel having an upper substantially planar surface and a lower substantially planar surface and an edge disposed between the upper and lower surfaces. A support structure is attached to the worksurface panel and positions the worksurface panel above the floor. At least one clamping device is secured to the worksurface panel proximate the edge of the worksurface panel, the clamping device having a plurality of attachment features. A first substantially vertically oriented substantially planar screen is secured to the clamping device in a position located outwardly proximate the edge of the worksurface panel, with the first screen being positioned sufficiently rearwardly of the worksurface panel edge to permit the passage of a conventional electrical power plug and is located between the first screen and the worksurface panel edge. A second substantially vertically oriented substantially planar screen is secured to the clamping device in a position placing the second screen inwardly of the edge of the worksurface, with the second screen being spaced from the worksurface panel at a distance which is sufficiently large to permit the passage of a conventional electrical power plug between the second screen and the worksurface panel. A substantial portion of the first screen is located on a first side of the worksurface panel and the second screen is located on the opposite side of the worksurface panel. In yet another aspect of the present invention, an accessory apparatus configured to releasably engage an edge of a worksurface includes at least one C-shaped clamping member having top and bottom legs and an intermediate section defining a cavity, the cavity being shaped and adapted to receive the edge of the worksurface, the clamping member including a pressure foot for engaging the edge to secure the clamping member in a selected position. The accessory apparatus includes a first attachment feature on one of the top leg, the bottom leg, and the intermediate section, and a second attachment feature on another of the top leg, the bottom leg, and the intermediate section. A first accessory is attached to the first attachment feature and a second accessory is attached to the second attachment feature.

In still another aspect of the present invention, an accessory mounting system includes at least one C-shaped clamp with legs and an intermediate section forming a cavity for engaging the edge of a worksurface, each of the legs and the intermediate section having an attachment feature. The system further includes accessories comprising an upright functional panel, a screen panel, and a functional device attachable to one or more of the attachment features, in various combinations, to provide a useful and flexible system.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 3:
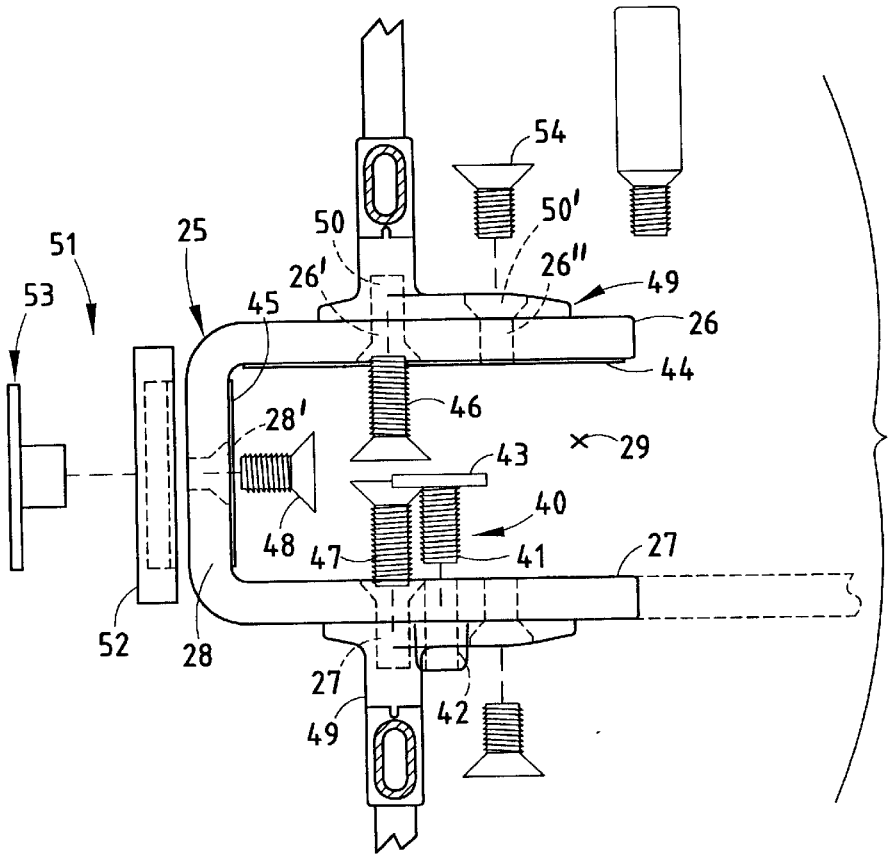
FIG. 3 is an exploded view of the circled area III in FIG. 1.
Figure 7:
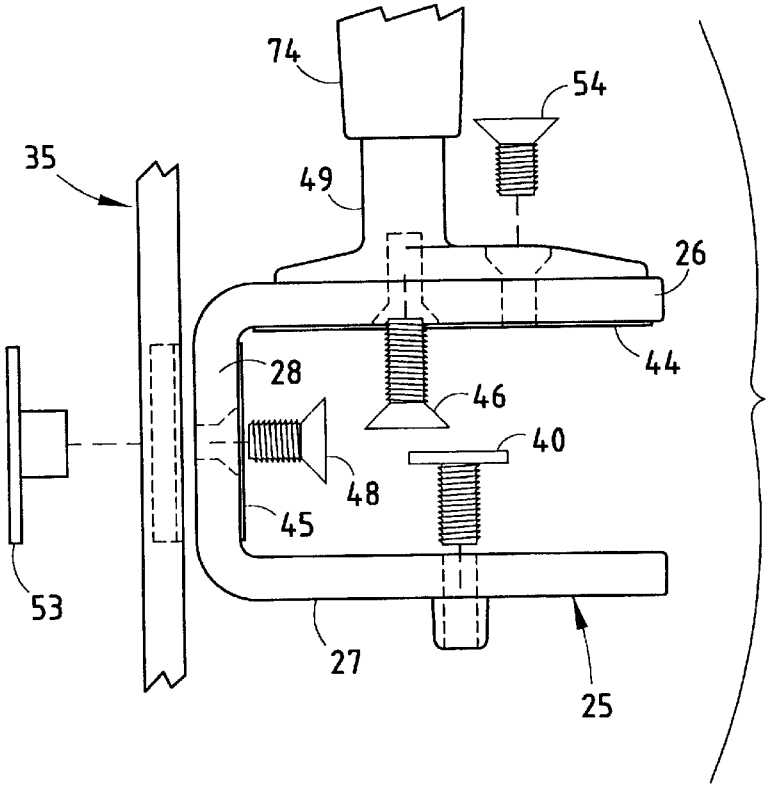
FIG. 7 is an exploded side view similar to FIG. 3, but showing a full-height screen attached to the C-clamp of FIG. 1.
Figure 12:
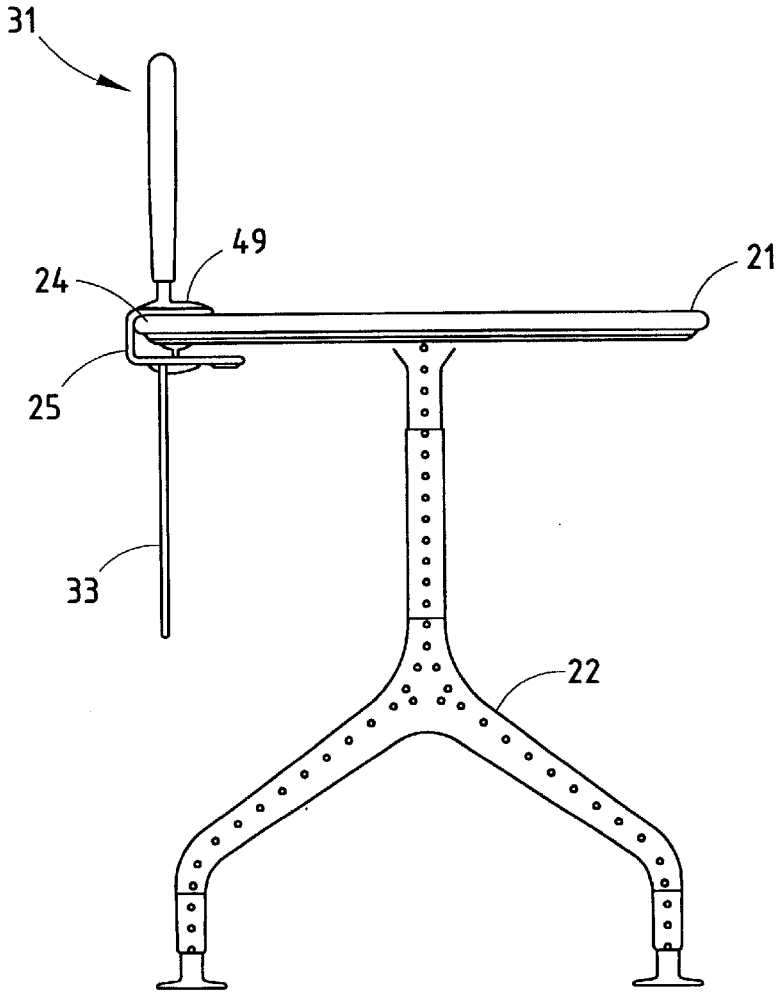
FIGS. 12–13 are side and front views of a desking system including an upright slatwall panel attached atop a worksurface and a downwardly-extending modesty screen.
Figure 13:
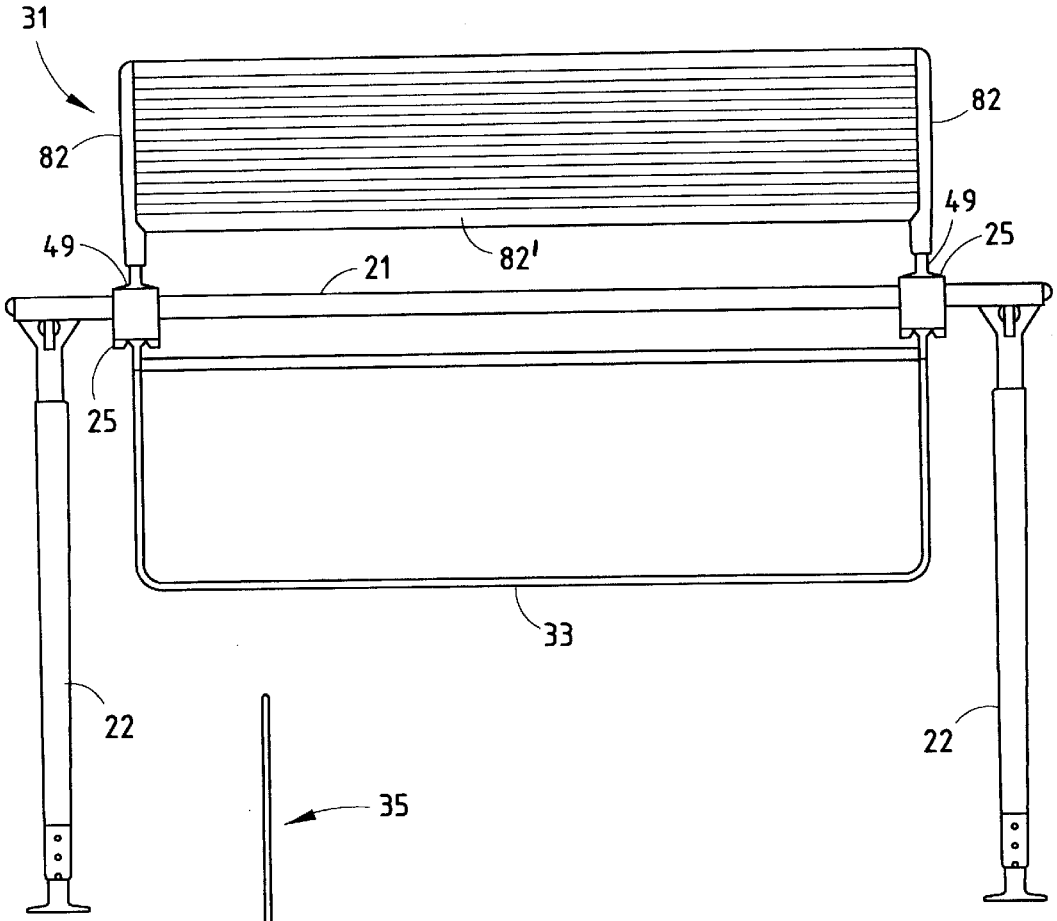
Figure 17:
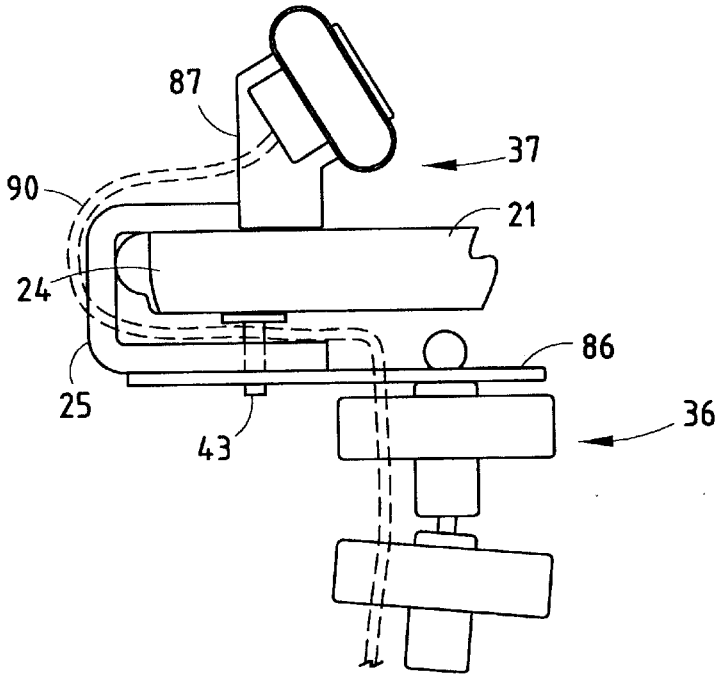
FIGS. 17–18 are fragmentary side and front views of a wire manager attached to the present mounting system.
Figure 18:
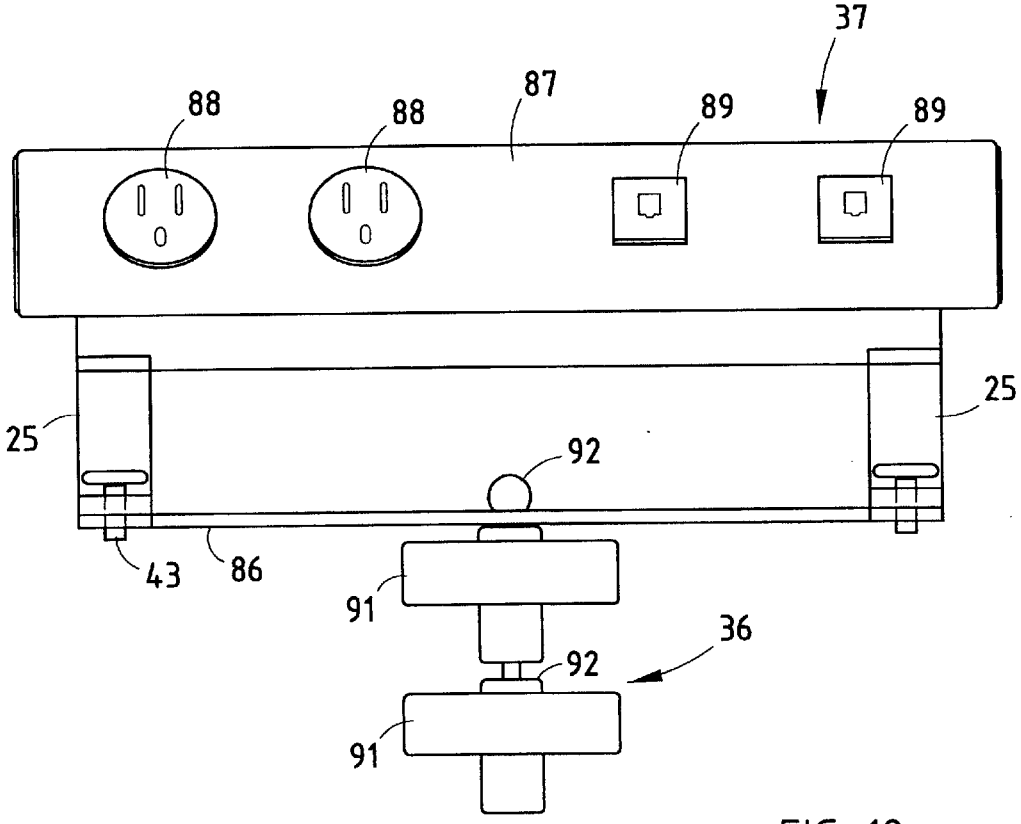

An office desking system 20 (FIG. 1) includes a worksurface 21 supported on legs 22, and an accessory system 23 configured for flexible and adjustable attachment to an edge 24 of the worksurface 21. The accessory system 23 includes C-shaped clamps 25 (FIG. 3) with legs 26 and 27 and an intermediate section 28 forming a cavity 29 for receiving and matably engaging the edge 24. Each of the legs 26–27 and the intermediate section 28 has an attachment feature, such as holes 26'–28'. The illustrated leg 26 includes a second attachment feature 26" as described hereafter. It is to be understood that the legs 26–27 and/or intermediate section 28 can have additional attachment features, if desired. Further, it is to be understood that the present accessory system 23 can be used with any worksurface system, and is not limited to only the illustrated leg-supported desk system. Accessories are provided, such as an upright slatwall panel 31 (FIGS. 12–13), an upright erasable panel (mounted like the arrangement of FIG. 12), an upright tackable panel (mounted like the arrangement of FIG. 12), an upright partial-height screen 32 (FIG. 1), a downwardly-extending modesty panel 33 (FIG. 1), a shelf 34 (FIG. 1), a "full height" up-and-down screen 35 (FIGS. 7 and 14), a wire manager 36, and utility outlet module 37 (FIGS. 17–18). Each of these accessories 31–37 are attachable to one or more of the attachment features 26'–28', in various combinations, to provide a useful and flexible accessory system.

The illustrated worksurface 21 is freestanding and is supported by a pair of the legs 22 along the rear edge 24. However, it is contemplated that the present invention will work on partition-panel-supported worksurfaces, independently-standing desk-type worksurfaces, and the like. Further, the present accessory mounting system can clamp to any edge of a worksurface, including side edges and/or a front edge. Accordingly, the present illustrations are not intended to be unnecessarily limiting.

The accessory system 23 includes a pair of C-shaped clamps 25 attached to a worksurface at horizontally spaced-apart locations. Each clamp 25 (FIG. 3) is C-shaped with top and bottom legs 26 and 27 and an intermediate section 28 forming a cavity 29 slightly larger in vertical height than the edge 24. A pair of holding members 40 include a threaded shaft 41 rotatably engaging threaded holes 42 in the bottom leg 27, and further include an enlarged foot 43 for clamping engagement with a bottom surface of the edge 24 of the worksurface 21. The foot 43 can be covered with a rubber or soft pad if desired to reduce damage to the edge 24. The bottom of the shaft 41 is adapted for turning, such as by including an outer hex-shaped head for engagement by a wrench, or an inner hex-shaped socket for engagement by an Allen wrench, or an outer finger-graspable surface. A rubber or soft pad 44 is located under the top leg 26 and a second rubber or soft pad 45 is located inside the intermediate section 28, to reduce damage to the edge 24 as the holding members 40 are turned to engage the edge 24.

The legs 26–27 and section 28 include non-threaded holes 26'–28'shaped to receive threaded screws 46–48. An accessory mounting foot 49 includes a hole 50 shaped to engage the top leg 26 and to receive the screw 46. The mounting foot 49 is also shaped to be inverted and engage a bottom surface of the bottom leg 27 and to receive the screw 47. A cover 51 includes a plate 52 and a nut 53 shaped to engage the screw 48 and to cover the attachment feature 28'. The plate 52 can extend between the pair of spaced clamps 25, if desired, to assist in spacing the clamps 25, or can be a small plate section provided only for aesthetics. The foot 49 includes a second hole 50' so that, where desired, a second screw 54 can be provided for engaging the forwardly-spaced attachment feature 26" on the top leg 26, for improved securement and stability of the foot 49. Notably, the clamps 25 can be inverted so that the "top" leg 26 is located under the worksurface 21. Alternatively, both legs 26 and 27 (and intermediate section 28) can be provided with a second attachment feature.

Figure 2:
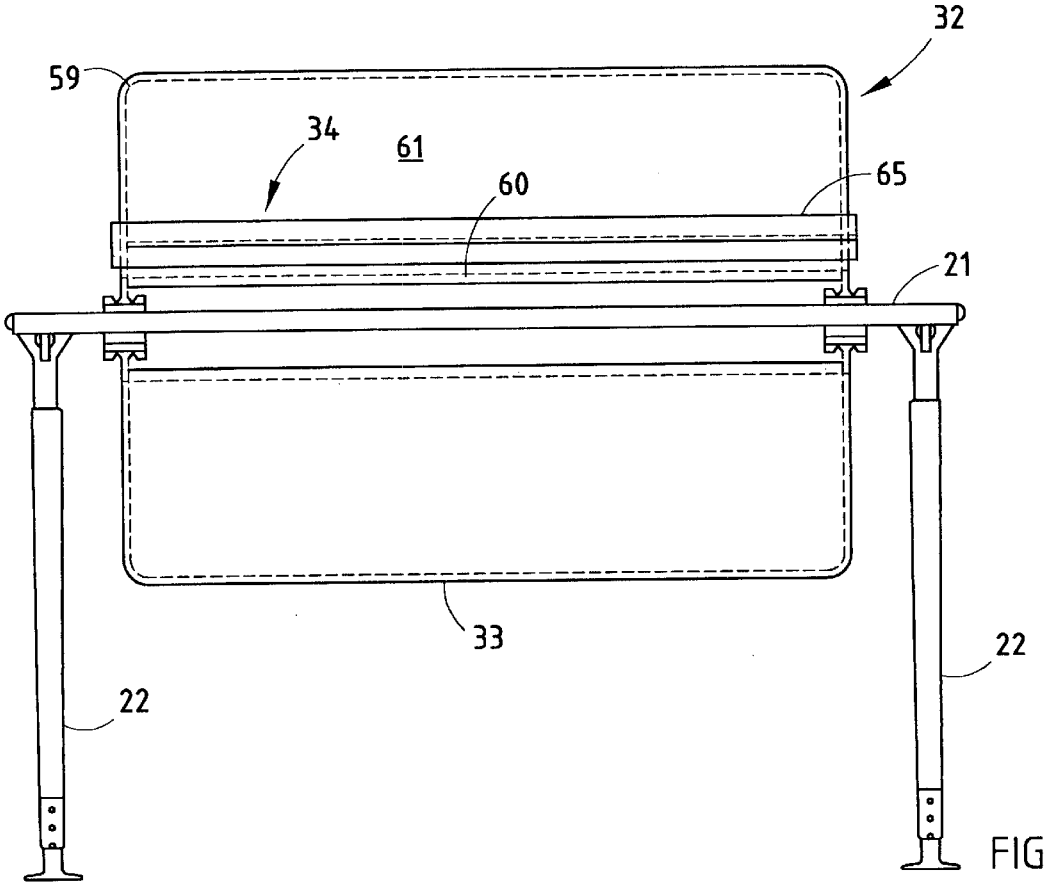
Figure 4:
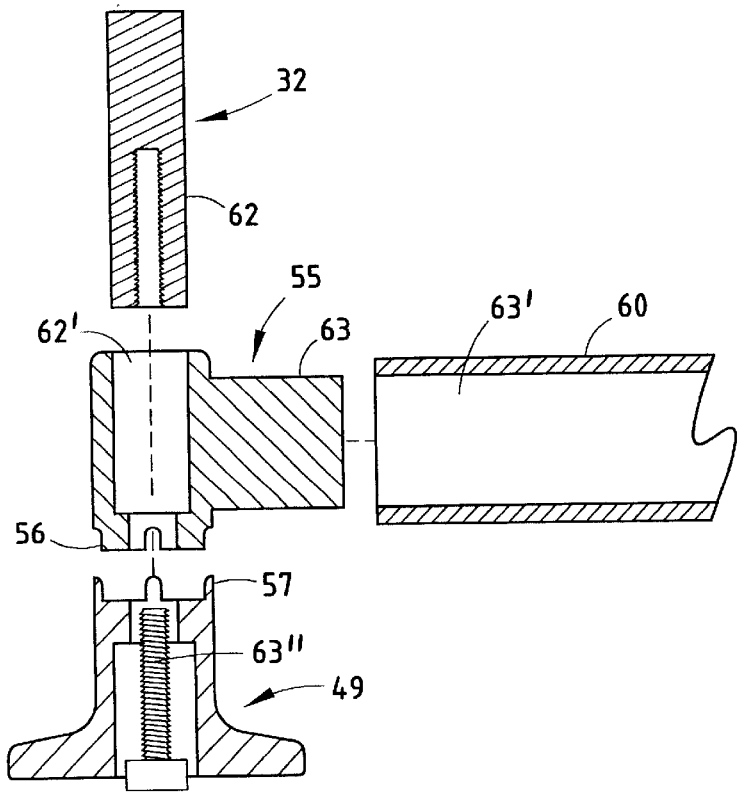
FIG. 4 is an exploded cross section along the line IV—IV in FIG. 3.
Figure 5:
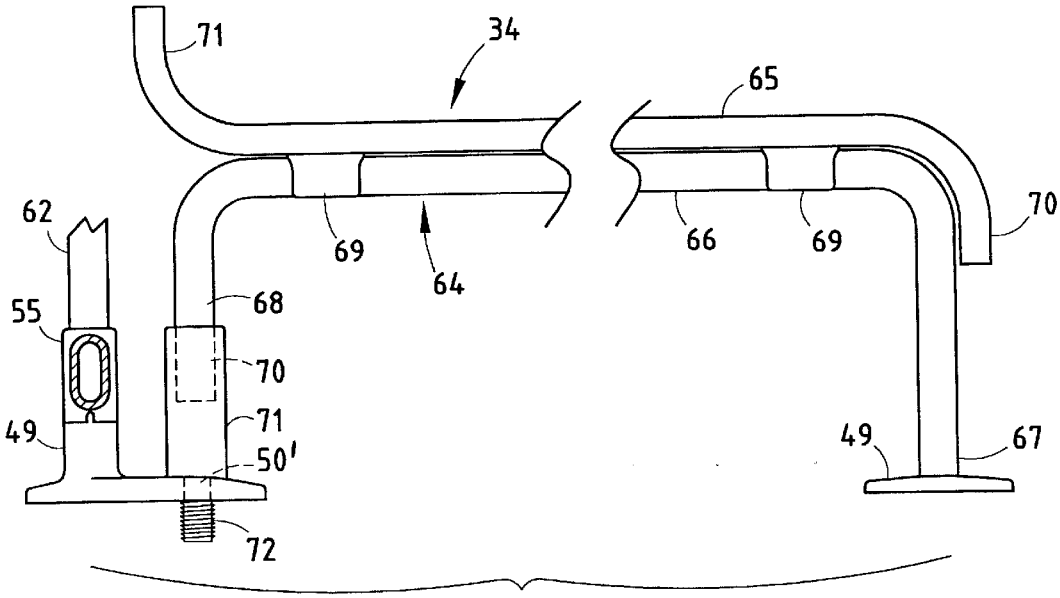
FIGS. 5–6 are enlarged side and front views of the shelf shown in FIG. 1.

As illustrated, the foot 49 is shaped for mating engagement with an adapter 55 (FIG. 4) for supporting a lightweight upright panel, such as the illustrated screen 32. The adapter 55 includes a downwardly facing crown-shaped section 56 shaped to mateably engage an upwardly facing crown-shaped section 57 on the foot 49 for non-rotatable friction-fit engagement. The crown-shaped sections 56/57 are shaped to engage and prevent rotation, but further are shaped so that they can be oriented in different angular positions. By this method, screens 32 extending between a pair of clamps 25 can be positioned at different orientations. For example it is contemplated that screens can be positioned across a corner of a worksurface or around a corner of a worksurface. The illustrated screen 32 (FIG. 2) includes a bent-wire U-shaped frame member 59 and a crosspiece 60, and further includes a sheet 61 covering the frame 59/60. The adapter 55 (FIG. 4) includes a top socket 62' which receives a bent-wire frame leg 62 of the frame member 59, and a side protrusion 63 for engaging a cavity 63' in an end of the crosspiece 60. Screws, such as screws 63 "can be used to secure the leg 62 in the adapter 55, or the joint can be made using adhesive or a friction fit.

Figure 6:
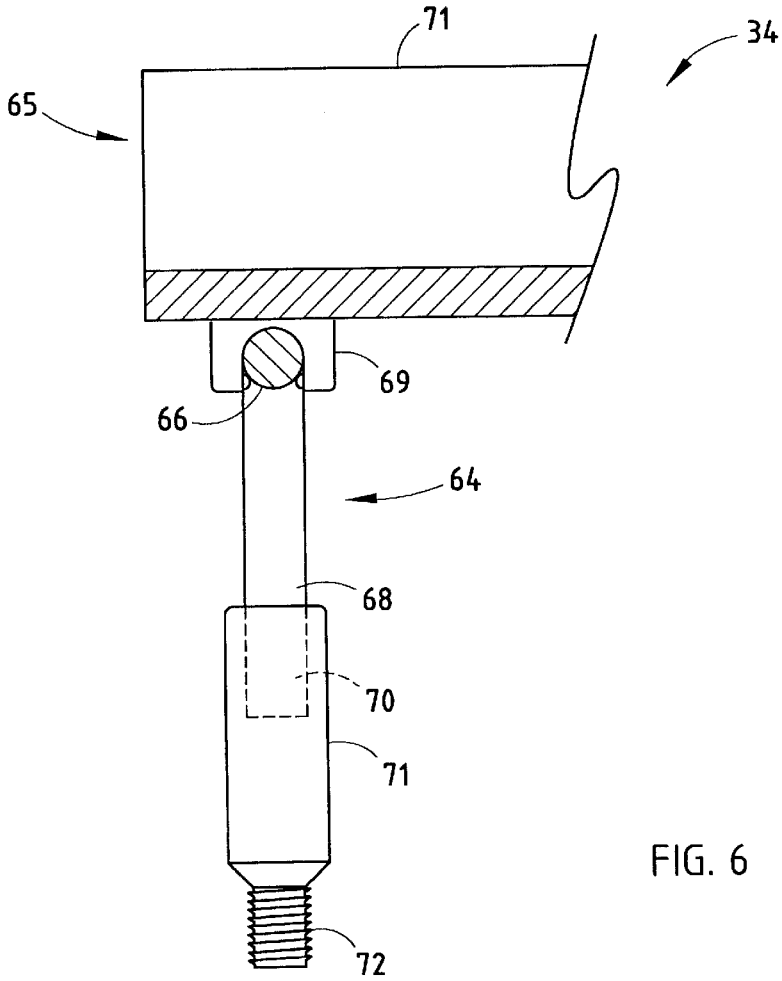

The shelf 34 (FIG. 6) includes a pair of spaced-apart shelf supports 64 and a shelf panel 65. The shelf support 64 includes a pair of parallel U-shaped bent-wire supports 66, each having a front foot 67 and a rear foot 68. The shelf panel 65 extends between the shelf supports 64 and is secured to the shelf supports 64, such as by plastic snap-attach clamps 69. The illustrated shelf panel 65 includes a "down waterfall" curved front lip 70 and an "up waterfall" curved rear lip 71, although various shapes and configurations are contemplated. The front foot 67 includes a pad 69 configured to reduce abrasion and damage to a top surface of the worksurface 21. The rear foot 68 frictionally (but rotatably) engages a socket 70 in a top of a nut 71. The nut 71 includes a threaded shaft 72 that extends through the hole 50' and threadably engages the hole 26" in the top leg 26. The nut 71 has an enlarged diameter and includes an outer surface configured so that the nut 71 can be secured tightly into the hole 26".

Figure 8:
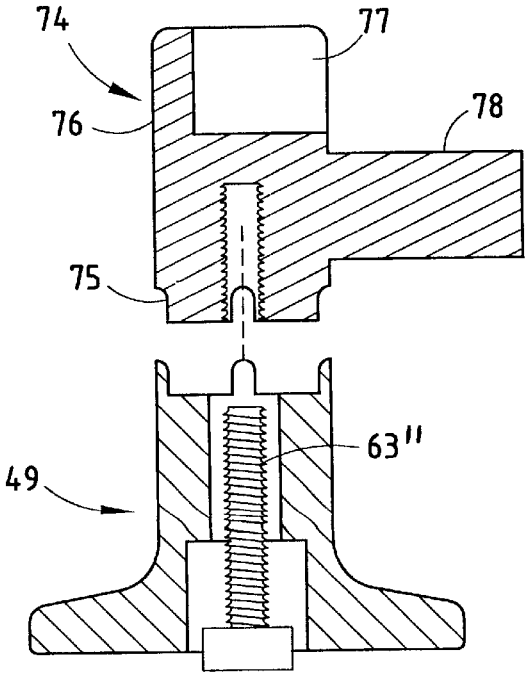
FIGS. 8–9 are cross sections taken in orthogonal directions of a modified mounting cap similar to the mounting cap shown in FIG. 4, but modified to support a structural panel, such as a wood panel, a tackable panel, or a slatwall panel.
Figure 9:
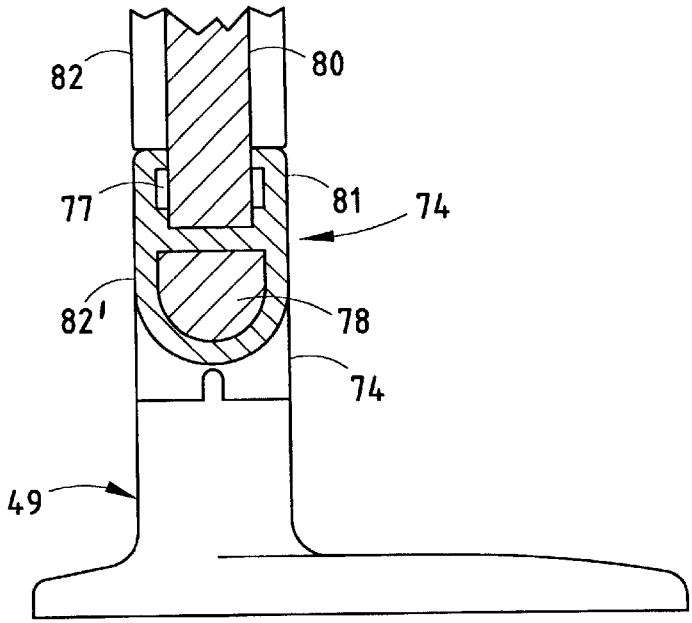

The adapter 55 can be replaced with a heavier-duty adapter, such as adapter 74 (FIG. 8). Adapter 74 has a lower end 75 configured with a crown shape (like adapter 55) to engage the foot 49. Adapter 74 further has an upper section 76 that defines a notch 77 and a stiff horizontal protrusion 78. The notch 77 is shaped to receive a board or panel 80 (FIG. 9), such as can be used to provide an erasable "whiteboard" surface, or to provide a tackable surface, or to provide a slatwall hang-on accessory-supporting surface, or to provide an aesthetic wood panel. The panel 80 can be secured in place with adhesive or with screws that extend through side flanges on the adapter 74. In FIG. 9, a vertical support brace 82 extends upwardly from the adapter 55 to stiffen and cover a side edge of the panel 80, and a second brace 82'extends horizontally for stiffening and covering a bottom edge of the panel 80.

Figure 1:
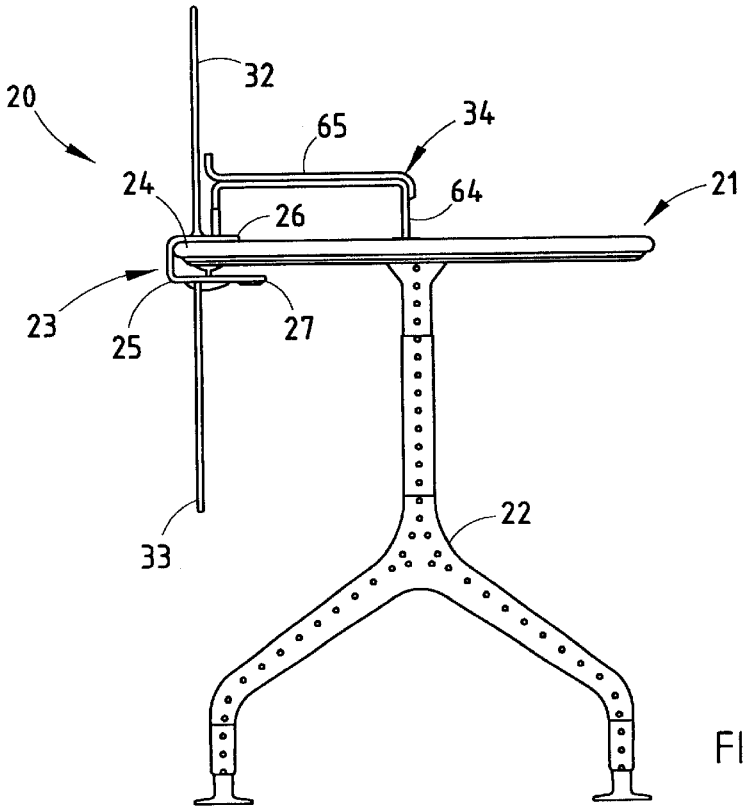
FIGS. 1–2 are side and front views of a desking system embodying the present invention, the desking system including a worksurface with an edge, and an accessory system including C-clamps for attachment to the edge and accessories attachable to the C-clamps.
Figure 14:
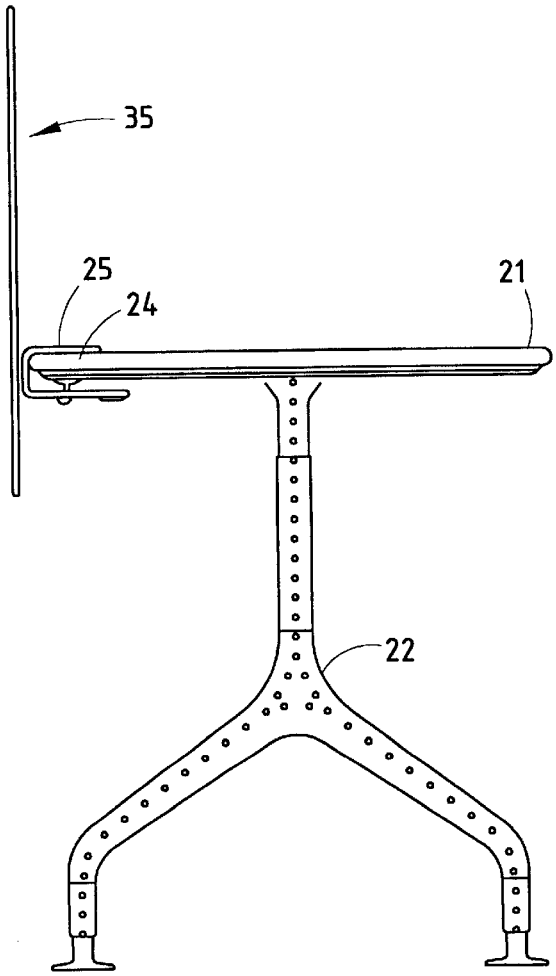
FIGS. 14–15 are side and rear views of a desking system including a full-height screen panel, with the screen panel extending a greater distance above the worksurface than below the worksurface.
Figure 15:
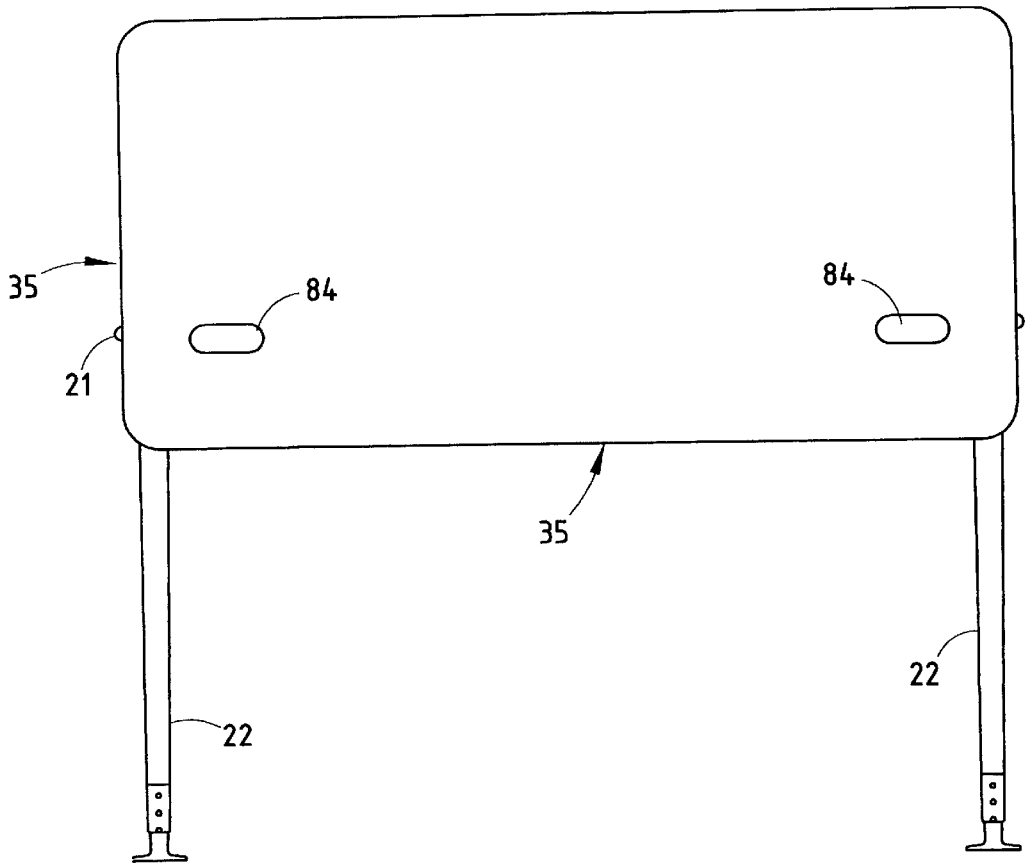
Figure 16:
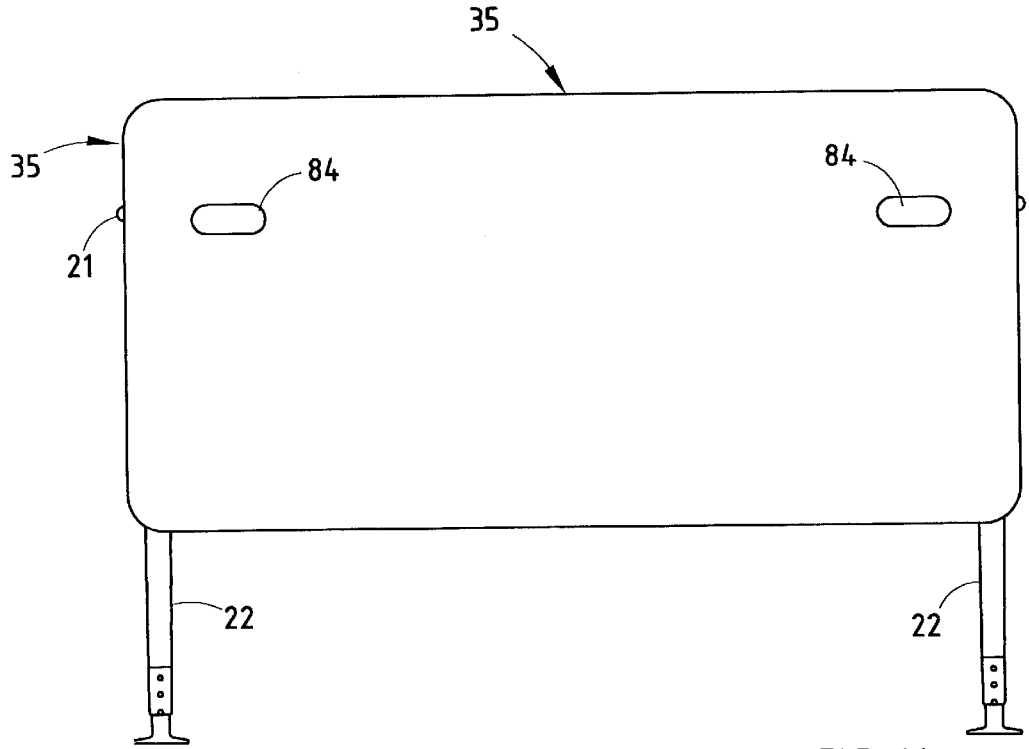
FIG. 16 is a rear view of the screen panel of FIG. 15, but with the screen panel attached so that it extends a greater distance below the worksurface than above.

The screen 32 (and/or screen 33) can be attached above or below the worksurface 21, or both, as shown in FIG. 1. Alternatively, a "full height" screen 35 (FIG. 7) can be attached to the intermediate section 28 of the clamp 25. It is contemplated that the illustrated screen 35 can be replaced with another panel (e.g. a wood panel, an erasable panel, a tackable panel, a slatwall panel, window panel, pass-through shelf-forming panel, or the like). Where desired, the screen 35 can be attached to the clamps 25 at a location spaced below its mid-point (FIG. 14). By this arrangement, the screen 35 can be positioned to provide primarily visual separation for office subdivision (with limited modesty screening) (FIGS. 14–15), or can be positioned to provide primarily modesty screening under the worksurface (with limited visual separation for office subdivision (FIG. 16). Apertures 84 can be provided in the screen 32 for pass through of wiring, if desired.

Figure 10:
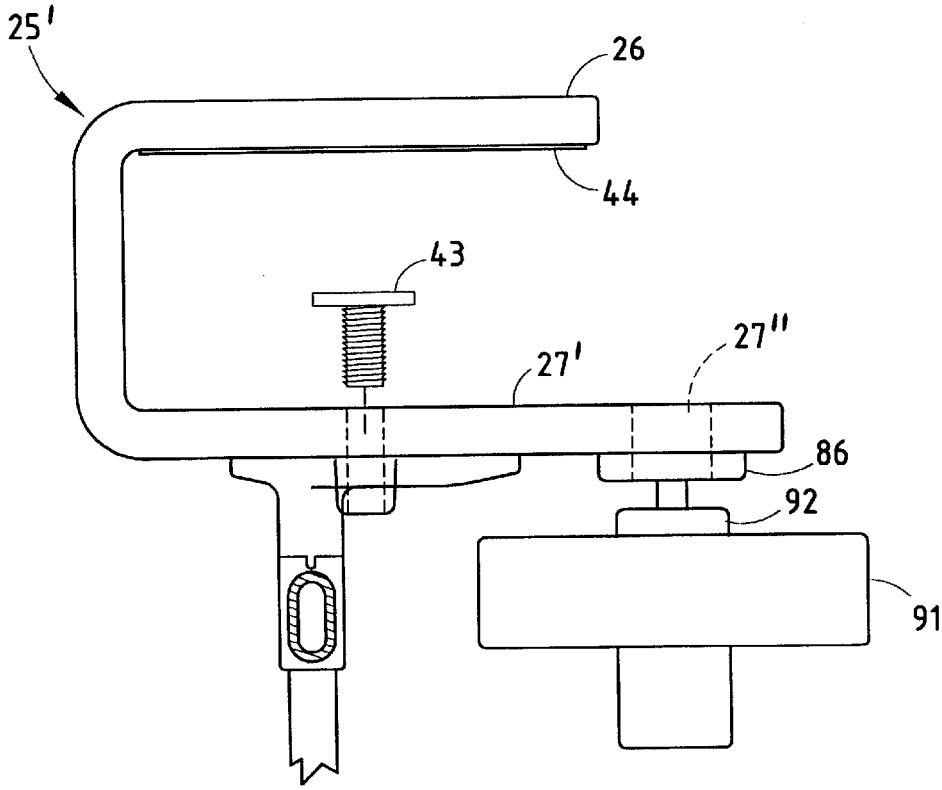
FIGS. 10–11 are side and front views of a modified C-clamp similar to FIG. 1, but having an elongated bottom leg configured to support a wire manager.
Figure 11:
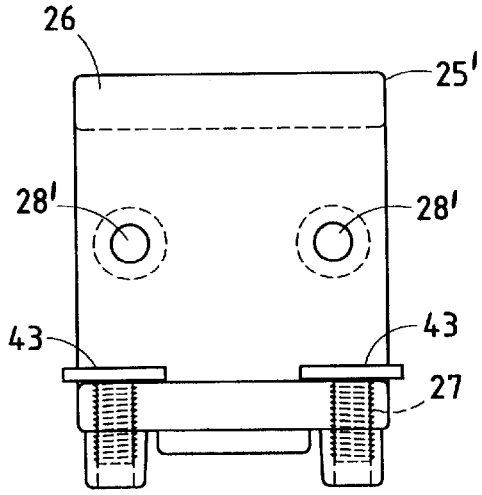

Additional accessories can be mounted to the present accessory mounting system. In FIG. 10, the clamp 25' includes an elongated leg 27' with an attachment hole 27". For example, a wire manager 36 (FIGS. 17–18) includes a mounting bar 86 attached to holes 27" between a lower portion of the clamps 25', and a utility outlet carrier 37 includes a housing 87 attached between an upper portion of clamps 25. The illustrated utility outlet carrier 37 (FIG. 17) includes a face with electrical power outlets 88 and telecommunication outlets 89 and wires 89'. A wire manager cable-protecting device is attached to the mounting bar 86 and extends downwardly toward a floor for protecting cables extending to and from the wire manager 36. The illustrated cable-protecting device includes disks 91 with radial slots for receiving wires 90, and joints 92 for providing flex and non-linear routing of the wires 90.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. A desking system for use in an interior office environment having a floor, said desking system comprising:

a worksurface panel having an upper substantially planar surface and a lower substantially planar surface and an edge disposed between said upper and lower surfaces;

a support structure attached to said worksurface panel and positioning said worksurface panel above the floor;

at least one clamping device secured to said worksurface panel proximate said edge of said worksurface panel, said clamping device having an upper clamp element positioned proximate said upper surface and a lower clamp element positioned proximate said lower surface;

said clamping device having at least three attachment features;

a first support extending from a first one of said attachment features, said first support secured to a first substantially vertically oriented planar member positioned above said upper surface;

a second support extending from a second one of said attachment features, said second support secured to a second substantially vertically oriented planar member positioned below said lower surface; and an accessory secured to a third one of said attachment features.

2. The desking system of claim 1, wherein said accessory is a shelf.

3. The desking system of claim 1, wherein said accessory is a cable management device.

4. The desking system of claim 1, wherein said first support and said second support are positioned substantially co-linearly.

5. The desking system of claim 1, further comprising a second clamping device having at least three attachment features and third and fourth supports attached to said second clamping device and respectively secured to said first and second vertically oriented planar members.

6. A desking system for use in an interior office environment having a floor, said desking system comprising:

a worksurface panel having an upper substantially planar surface and a lower substantially planar surface and an edge disposed between said upper and lower surfaces;

a support structure attached to said worksurface panel and positioning said worksurface panel above the floor;

at least one clamping device secured to said worksurface panel proximate said edge of said worksurface panel, said clamping device having a plurality of attachment features;

a first substantially vertically oriented substantially planar screen securable to said clamping device in first and second positions, each of said first and second positions being located outwardly proximate said edge of said worksurface panel, wherein when said first screen is located in said first position, a majority of said first screen is located below said worksurface panel and wherein when said first screen is located in said second position, a majority of said first screen is located above said worksurface panel;

a second substantially vertically oriented substantially planar screen securable to said clamping device in third and fourth positions, said third position placing said second screen above said worksurface panel inwardly of said edge of said worksurface panel and said fourth position placing said second screen below said worksurface panel inwardly of said edge of said worksurface panel.

7. The desking system of claim 6, wherein placement of said first screen in said first position and of said second screen in said third position positions an upper edge of said first screen at a height which is above a lower edge of said second screen and wherein placement of said first screen in said second position and of said second screen in said fourth position positions a lower edge of said first screen at a height which is lower than an upper edge of said second screen.

8. The desking system of claim 6, wherein said second screen comprises a wire rod frame and a fabric covering.

9. The desking system of claim 6, wherein said first screen is positioned sufficiently rearwardly of said worksurface panel edge to permit the passage of a conventional electrical power plug between said first screen and said worksurface panel edge.

10. The desking system of claim 9, wherein said second screen is spaced from the worksurface panel at a distance which is sufficiently large to permit the passage of a conventional electrical power plug between said second screen and said worksurface panel.

11. A desking system for use in an interior office environment having a floor, said desking system comprising:

a worksurface panel having an upper substantially planar surface and a lower substantially planar surface and an edge disposed between said upper and lower surfaces;

a support structure engaging and attached to said worksurface panel and adapted to position said worksurface panel above the floor;

at least one clamping device engaging and secured to said worksurface panel proximate said edge of said worksurface panel by a first fastener, said clamping device having a plurality of attachment features;

a shelf having a support, said support engaging and secured to said clamping device at one of said attachment features by a second fastener so that said shelf is disposed at height above and at an orientation substantially parallel to said worksurface panel; and a substantially vertically oriented substantially planar screen; said screen engaging and secured to said clamping device by a third fastener at one of said attachment features.

12. The desking system of claim 11, wherein said screen comprises a support extending upwardly from said clamping device and said screen is disposed proximate a rear edge of said shelf and a substantial portion of said screen is disposed at a height above said shelf.

13. The desking system of claim 11, wherein said screen is disposed outwardly of said worksurface panel edge.

14. The desking system of claim 11, wherein said screen comprises a support extending downwardly from said clamping device.

15. A desking system for use in an interior office environment having a floor, said desking system comprising:

a worksurface panel having an upper substantially planar surface and a lower substantially planar surface and an edge disposed between said upper and lower surfaces;

a support structure attached to said worksurface panel and positioning said worksurface panel above the floor;

at least one clamping device secured to said worksurface panel proximate said edge of said worksurface panel, said clamping device having a plurality of attachment features;

a first substantially vertically oriented substantially planar screen secured to said clamping device in a position located outwardly proximate said edge of said worksurface panel and wherein said first screen is positioned sufficiently rearwardly of said worksurface panel edge to permit the passage of a conventional electrical power plug between said first screen and said worksurface panel edge;

a second substantially vertically oriented substantially planar screen securable to said clamping device in a position placing said second screen inwardly of said edge of said worksurface and wherein said second screen is spaced from the worksurface panel at a distance which is sufficiently large to permit the passage of a conventional electrical power plug between said second screen and said worksurface panel;

and wherein a substantial portion of said first screen is located on a first side of said worksurface panel and said second screen is located on the opposite side of said worksurface panel.

16. The desking system of claim 15, wherein said substantial portion of said first screen is located above said worksurface panel and said second screen is located below said worksurface panel.

17. The desking system of claim 15, wherein said substantial portion of said first screen is located below said worksurface panel and said second screen is located above said worksurface panel.

18. The desking system of claim 17, wherein said second screen includes a plurality of slats for attaching accessories to said second screen.

19. The desking system of claim 17, wherein said second screen includes a tackable portion.

20. An accessory apparatus configured to releasably engage an edge of a worksurface comprising:

at least one C-shaped clamping member having top and bottom legs and an intermediate section defining a cavity, the cavity being shaped and adapted to receive the edge of the worksurface, the clamping member including a pressure foot for engaging the edge to secure the clamping member in a selected position;

a first attachment feature on one of the top leg, the bottom leg, and the intermediate section, and a second attachment feature on another of the top leg, the bottom leg, and the intermediate section; and a first accessory attached to the first attachment feature and a second accessory attached to the second attachment feature.

21. The accessory apparatus defined in claim 20, including a third attachment feature on another of the top leg, the bottom leg, and the intermediate section, and a third accessory attached to the third attachment feature.

22. The accessory apparatus defined in claim 21, wherein the first, second and third attachment features are on the top leg, the bottom leg, and the intermediate section, respectively.

23. The accessory apparatus defined in claim 21, wherein the first, second, and third accessories include an upwardly-extending panel that extends above the clamping member, a modesty panel, and a shelf.

24. An accessory system configured and adapted for attachment to an edge of a worksurface, the accessory system comprising:

an accessory mounting system including at least one C-shaped clamp with legs and an intermediate section forming a cavity for engaging the edge of a worksurface, each of the legs and the intermediate section having an attachment feature; and accessories including an upright functional panel, a screen panel, and a functional device attachable to one or more of the attachment features, in various combinations, to provide a useful and flexible system.

25. The accessory system defined in claim 24, wherein the attachment features each include threaded holes.

26. The accessory system defined in claim 24, wherein one of the legs includes a second attachment feature.

27. The accessory system defined in claim 24, wherein the upright functional panel includes an upright erasable panel, and further including an upright tackable panel, a shelf, and a downwardly-extending modesty panel, and wherein the functional device includes a wire manager.

* * * * *